US009778582B2

(12) United States Patent
Kitamura et al.

(10) Patent No.: US 9,778,582 B2
(45) Date of Patent: Oct. 3, 2017

(54) ELECTROPHOTOGRAPHIC PHOTOSENSITIVE MEMBER, PROCESS CARTRIDGE, AND ELECTROPHOTOGRAPHIC APPARATUS INCORPORATING AN IMPROVED UNDERCOAT LAYER

(71) Applicant: CANON KABUSHIKI KAISHA, Tokyo (JP)

(72) Inventors: Wataru Kitamura, Numazu (JP); Ryoichi Tokimitsu, Mishima (JP); Yuka Ishiduka, Suntou-gun (JP); Mai Murakami, Numazu (JP); Kenichi Kaku, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 932 days.

(21) Appl. No.: 13/688,786

(22) Filed: Nov. 29, 2012

(65) Prior Publication Data

US 2015/0346620 A1 Dec. 3, 2015

(30) Foreign Application Priority Data

Nov. 30, 2011 (JP) ..... 2011-262120
Nov. 6, 2012 (JP) ..... 2012-244529

(51) Int. Cl.

| | |
|---|---|
| ***G03G 21/16*** | (2006.01) |
| ***G03G 5/14*** | (2006.01) |
| ***G03G 5/047*** | (2006.01) |
| ***G03G 5/06*** | (2006.01) |

(52) U.S. Cl.
CPC ..... *G03G 5/144* (2013.01); *G03G 5/047* (2013.01); *G03G 5/0609* (2013.01); *G03G 5/0611* (2013.01); *G03G 5/142* (2013.01)

(58) Field of Classification Search
None
See application file for complete search history.

(56) References Cited

U.S. PATENT DOCUMENTS

| | | | | |
|---|---|---|---|---|
| 5,401,617 | A * | 3/1995 | Kato | G03F 7/0226 430/165 |
| 5,663,032 | A * | 9/1997 | Fukui | G03F 7/0285 430/203 |
| 6,610,815 | B1 * | 8/2003 | Hata | C08G 73/10 430/283.1 |
| 8,415,078 | B2 * | 4/2013 | Tanaka | G03G 5/0614 399/159 |
| 8,802,337 | B2 * | 8/2014 | Kawasaki | G03G 5/144 399/111 |
| 8,841,052 | B2 * | 9/2014 | Watariguchi | G03G 5/142 430/58.5 |

(Continued)

FOREIGN PATENT DOCUMENTS

| | | |
|---|---|---|
| CN | 1203383 A | 12/1998 |
| CN | 102053515 A | 5/2011 |

(Continued)

*Primary Examiner* — David M Gray
*Assistant Examiner* — Geoffrey T Evans
(74) *Attorney, Agent, or Firm* — Canon U.S.A., Inc. IP Division

(57) ABSTRACT

An electrophotographic photosensitive member includes an undercoat layer that includes metal oxide particles and a compound having at least three hydroxyl groups and a carbonyl or dicarbonyl group.

7 Claims, 3 Drawing Sheets

(56) References Cited

U.S. PATENT DOCUMENTS

| | | | | |
|---|---|---|---|---|
| 8,974,991 | B2 * | 3/2015 | Kawahara | C09B 47/045 399/159 |
| 9,535,347 | B2 * | 1/2017 | Watariguchi | G03G 5/142 |
| 2004/0094752 | A1 * | 5/2004 | Ito | G03F 7/0047 252/578 |
| 2006/0014091 | A1 * | 1/2006 | Nukada | G03G 5/0696 430/60 |
| 2009/0035674 | A1 | 2/2009 | Wu | |
| 2009/0061340 | A1 * | 3/2009 | Lin | G03G 5/047 430/58.8 |
| 2009/0162767 | A1 | 6/2009 | Wu | |
| 2014/0295344 | A1 * | 10/2014 | Murakami | G03G 5/0525 430/131 |
| 2016/0032145 | A1 * | 2/2016 | Drumheller | A61L 31/10 427/2.25 |

FOREIGN PATENT DOCUMENTS

| | | | |
|---|---|---|---|
| EP | 1921507 | A2 | 5/2008 |
| JP | 58-017450 | A | 2/1983 |
| JP | 2006030698 | A | 2/2006 |
| JP | 2006-221094 | A | 8/2006 |
| JP | 2008-310307 | A | 12/2008 |
| RU | 2416813 | C2 | 4/2011 |

* cited by examiner

ELECTROPHOTOGRAPHIC PHOTOSENSITIVE MEMBER, PROCESS CARTRIDGE, AND ELECTROPHOTOGRAPHIC APPARATUS INCORPORATING AN IMPROVED UNDERCOAT LAYER

BACKGROUND OF THE INVENTION

Field of the Invention

The present invention relates to an electrophotographic photosensitive member, a process cartridge, and an electrophotographic apparatus.

Description of the Related Art

An electrophotographic photosensitive member including a support, an undercoat layer formed on the support, and a photosensitive layer formed on the undercoat layer and containing an organic charge generating substance and an organic charge transporting substance has been used as electrophotographic photosensitive members for electrophotographic apparatuses. The undercoat layer has a charge-blocking function and thus suppresses the charge injection from the support to the photosensitive layer. Consequently, formation of image defects such as black spots is suppressed.

In recent years, charge generating substances having higher sensitivity have been used. However, such an increase in the sensitivity of charge generating substances results in an increase in the amount of charge generated. As a result, charge easily remains in the photosensitive layer, which poses a problem in that ghosts are easily formed. Specifically, a so-called "positive ghost" phenomenon in which an image density increases only in a portion irradiated with light in the previous rotation or a so-called "negative ghost" phenomenon in which an image density decreases only in a portion irradiated with light in the previous rotation easily occurs in an output image.

Japanese Patent Laid-Open No. 2006-221094 discloses a technique in which an undercoat layer includes a metal oxide and a compound having an anthraquinone structure in order to suppress such a ghost phenomenon.

In recent years, with an increasing number of electrophotographic apparatuses having a color function, higher speed and higher image quality have been required for such electrophotographic apparatuses, and higher performance has been also required for electrophotographic photosensitive members. For example, the degradation of image quality caused by a ghost phenomenon needs to be suppressed in various environments.

However, the technique disclosed in Japanese Patent Laid-Open No. 2006-221094 still has room for improvement because the degradation of image quality caused by a ghost phenomenon is not sufficiently suppressed.

SUMMARY OF THE INVENTION

The present invention provides an electrophotographic photosensitive member in which the degradation of image quality caused by a ghost phenomenon is suppressed in the repeated use of the photosensitive member. The present invention also provides a process cartridge and an electrophotographic apparatus each including the electrophotographic photosensitive member.

In an aspect of the present invention, an electrophotographic photosensitive member includes a support, an undercoat layer formed on the support, and a photosensitive layer formed on the undercoat layer. The undercoat layer includes metal oxide particles and a compound represented by the following formula (1).

(1)

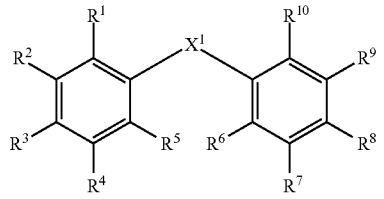

In the formula (1), $R^1$ to $R^{10}$ each independently represents a hydrogen atom, a halogen atom, a hydroxy group, an alkyl group, an alkoxy group, or an amino group. At least one of $R^1$ to $R^{10}$ is an amino group or a hydroxy group. $X^1$ represents a carbonyl group or a dicarbonyl group.

In another aspect of the present invention, a process cartridge detachably attachable to a main body of an electrophotographic apparatus integrally supports the electrophotographic photosensitive member described above and at least one device selected from the group consisting of a charging device, a developing device, a transferring device, and a cleaning device.

In another aspect of the present invention, an electrophotographic apparatus includes the electrophotographic photosensitive member described above, a charging device, an exposure device, a developing device, and a transferring device.

The present invention can provide an electrophotographic photosensitive member in which the degradation of image quality caused by a ghost phenomenon is suppressed in various environments. The present invention can also provide a process cartridge and an electrophotographic apparatus each including the electrophotographic photosensitive member.

Further features of the present invention will become apparent from the following description of exemplary embodiments with reference to the attached drawings.

DESCRIPTION OF THE EMBODIMENTS

Figure 1:
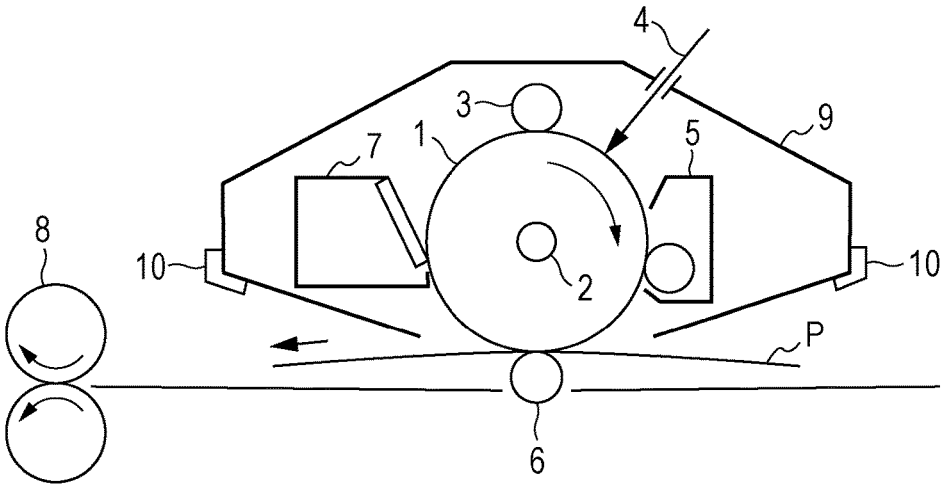
FIG. 1 is a schematic view showing an example of an electrophotographic apparatus that includes a process cartridge including an electrophotographic photosensitive member according to an embodiment of the present invention.

In an embodiment of the present invention, an undercoat layer of an electrophotographic photosensitive member includes metal oxide particles and a compound represented by formula (1) below.

(1)

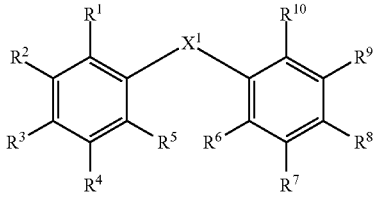

In the formula (1), $R^1$ to $R^{10}$ each independently represents a hydrogen atom, a halogen atom, a hydroxy group, an alkyl group, an alkoxy group, or an amino group. At least one of $R^1$ to $R^{10}$ is an amino group or a hydroxy group. $X^1$ represents a carbonyl group or a dicarbonyl group.

The inventors of the present invention assume the reason why a ghost phenomenon is suppressed by adding the metal oxide particles and the compound represented by the formula (1) above to an undercoat layer to be as follows.

It is believed that metal oxide particles contained in an undercoat layer are easily oxidized after the repeated use of a photosensitive member, and thus the amount of charge (electrons) received from a photosensitive layer is decreased and a ghost phenomenon is easily caused.

The compound represented by the formula (1) is a benzophenone compound having an amino group or a hydroxy group. The compound represented by the formula (1) is believed to have a high dipole moment and easily draw charge because of its benzophenone structure. The structure represented by the formula (1) may provide an interaction between the compound represented by the formula (1) and the metal oxide particles, resulting in the formation of an intramolecular charge transfer complex. It is believed that the intramolecular charge transfer complex between the compound represented by the formula (1) and the metal oxide particles is formed in the undercoat layer, whereby the oxidation of the metal oxide particles is suppressed and charge (electron) is easily received. Consequently, it is believed that electrons are smoothly received from a photosensitive layer (charge generating layer), and electrons are smoothly given and received between the metal oxide particles by drawing electrons from the metal oxide particles, which suppresses the formation of ghosts.

It is disclosed in Japanese Patent Laid-Open No. 58-017450 that a benzophenone compound is added to an undercoat layer in order to suppress the degradation of a charge transporting substance caused by ultraviolet rays. However, it is believed that, in the technique of Japanese Patent Laid-Open No. 58-017450, metal oxide particles are not contained in the undercoat layer and thus there is no interaction between the metal oxide particles and the benzophenone compound, which does not provide sufficiently high sensitivity.

Specific examples of the compounds represented by the formula (1) are described below, but the present invention is not limited thereto.

(1-1)

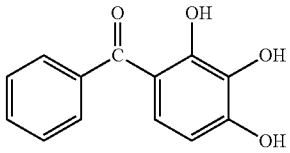

-continued (1-2)

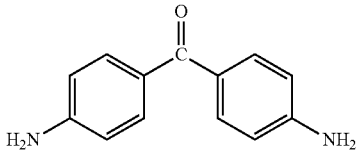

(1-3)

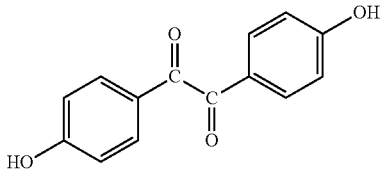

(1-4)

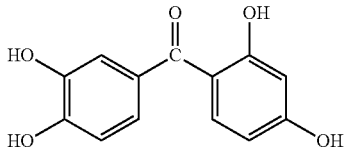

(1-5)

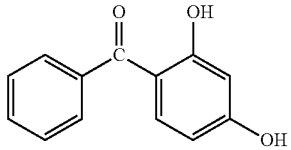

(1-6)

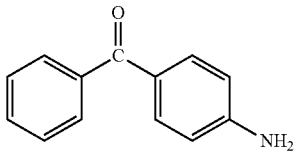

(1-7)

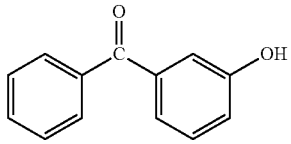

(1-8)

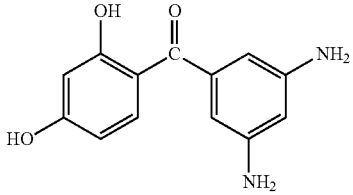

(1-9)

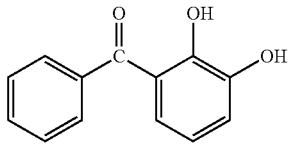

(1-10)

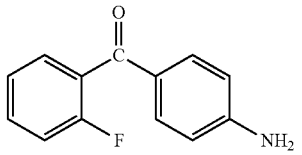

-continued (1-11)

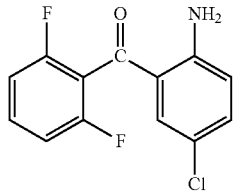

(1-12)

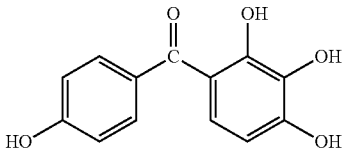

(1-13)

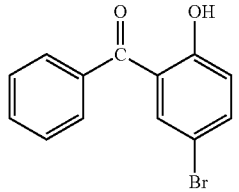

(1-14)

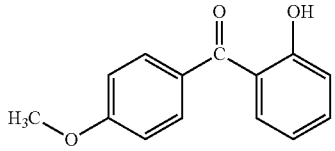

(1-15)

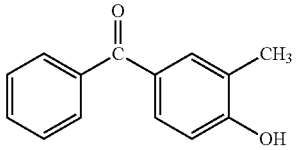

(1-16)

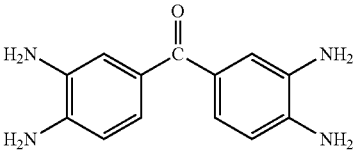

(1-17)

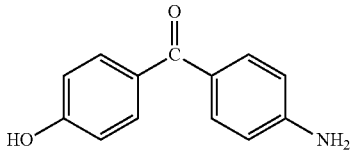

(1-18)

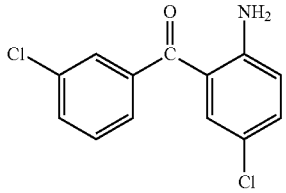

(1-19)

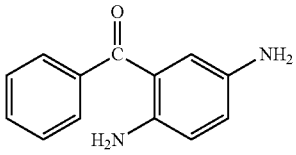

-continued (1-20)

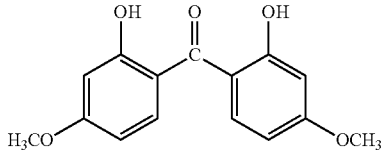

(1-21)

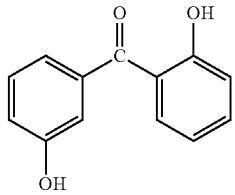

(1-22)

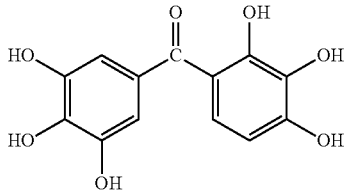

(1-23)

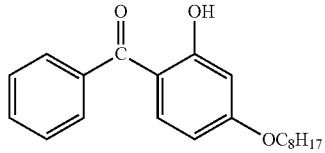

(1-24)

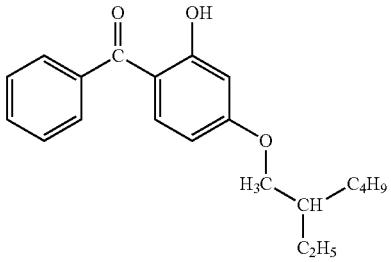

(1-25)

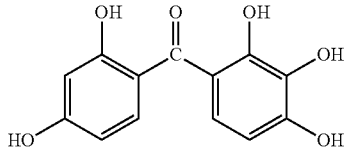

(1-26)

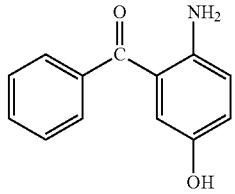

In the compounds represented by the formula (1), at least three of substituent groups $R^1$ to $R^{10}$ can be hydroxy groups in terms of the interaction with metal oxide particles. Furthermore, at least one compound selected from the group consisting of the compounds represented by the formulae (1-1), (1-4), (1-12), (1-22), and (1-25) can be used to suppress a ghost phenomenon in the repeated use.

The content of the compound represented by the formula (1) in the undercoat layer can be not less than 0.05% by mass and not more than 4% by mass relative to the total mass of the metal oxide particles in the undercoat layer. When the content is not less than 0.05% by mass, the compound represented by the formula (1) and the metal oxide particles sufficiently interact with each other, which produces an excellent effect of suppressing a ghost phenomenon. When the content is not more than 4% by mass, the interaction between the compounds represented by the formula (1) is suppressed, which produces an excellent effect of suppressing a ghost phenomenon.

In an embodiment of the present invention, the undercoat layer includes the metal oxide particles, the compound represented by the formula (1), and furthermore a binder resin. Examples of the binder resin include acrylic resin, allyl resin, alkyd resin, ethyl cellulose resin, ethylene-acrylic acid copolymers, epoxy resin, casein resin, silicone resin, gelatin resin, phenolic resin, butyral resin, polyacrylate resin, polyacetal resin, polyamide-imide resin, polyamide resin, polyallyl ether resin, polyimide resin, polyurethane resin, polyester resin, polyethylene resin, polycarbonate resin, polystyrene resin, polysulfone resin, polyvinyl alcohol resin, polybutadiene resin, and polypropylene resin. Among them, polyurethane resin can be particularly used.

The content of the binder resin in the undercoat layer can be 10% by mass or more and 50% by mass or less relative to the mass of the metal oxide particles. When the content is 10% by mass or more and 50% by mass or less, high uniformity of the undercoat layer is achieved.

In an embodiment of the present invention, the metal oxide particles contained in the undercoat layer can be particles containing titanium oxide, zinc oxide, tin oxide, zirconium oxide, or aluminum oxide and, in particular, can be particles containing titanium oxide or zinc oxide. The metal oxide particles may be metal oxide particles whose surface is treated with a surface-treating agent such as a silane coupling agent.

Figure 2:
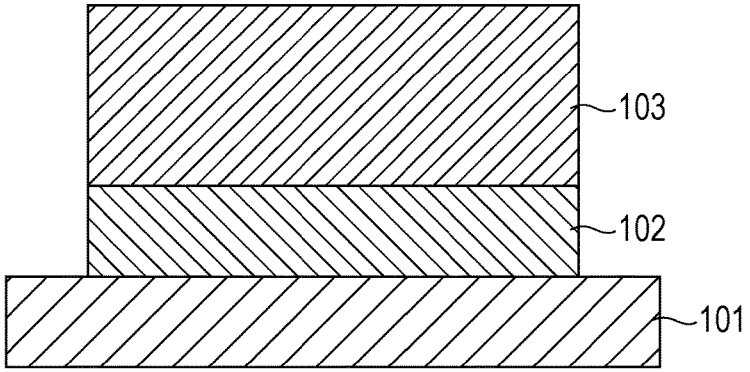
FIG. 2 is a diagram showing an example of a layer structure of the electrophotographic photosensitive member according to an embodiment of the present invention.

The electrophotographic photosensitive member according to an embodiment of the present invention includes, for example, a support 101, an undercoat layer 102 disposed on the support 101, and a photosensitive layer 103 disposed on the undercoat layer 102 as shown in FIG. 2.

The photosensitive layer may be a monolayer photosensitive layer that contains a charge generating substance and a charge transporting substance or a multilayer (function-separated) photosensitive layer that includes a charge generating layer containing a charge generating substance and a charge transporting layer containing a charge transporting substance. In an embodiment of the present invention, the function-separated (multilayer) photosensitive layer including a charge generating layer and a charge transporting layer formed on the charge generating layer can be used. A protective layer may be further formed on the photosensitive layer.

Support

A support used in an embodiment of the present invention is a support having electrical conductivity (electroconductive support), for example, made of a metal or an alloy such as aluminum, stainless steel, copper, nickel, or zinc. An aluminum or aluminum alloy support may be an ED tube, an EI tube, or a support manufactured by cutting, electrochemical mechanical polishing (electrolysis performed with electrodes and an electrolytic solution that provide an electrolysis action and polishing performed with grindstone that provides a polishing action), or wet or dry honing of the ED or EI tube. A metal support or a resin support may be covered with a thin film made of an electroconductive material such as aluminum, an aluminum alloy, or an indium oxide-tin oxide alloy. The support can have a cylindrical shape or a belt-like shape and, in particular, can have a cylindrical shape.

The surface of the support may be subjected to a cutting treatment, a surface roughening treatment, or an anodizing treatment to suppress interference fringes caused by scattering of laser beams.

An electroconductive layer may be formed between the support and the undercoat layer to suppress interference fringes caused by scattering of laser beams or to cover scratches formed on the support. The electroconductive layer can be formed by applying an electroconductive layer coating solution prepared by dispersing carbon black and conductive particles together with a binder resin and a solvent and drying (heat curing) the electroconductive layer coating solution by heating.

Examples of the binder resin used for the electroconductive layer include polyester resin, polycarbonate resin, polyvinyl butyral resin, acrylic resin, silicone resin, epoxy resin, melamine resin, urethane resin, phenolic resin, and alkyd resin.

Examples of the solvent for the electroconductive layer coating solution include ether solvents, alcohol solvents, ketone solvents, and aromatic hydrocarbon solvents. The thickness of the electroconductive layer is preferably 5 to 40 μm and particularly preferably 10 to 30 μm.

Undercoat Layer

The undercoat layer is formed between the support or the electroconductive layer and the photosensitive layer (charge generating layer).

The undercoat layer can be formed by preparing an undercoat layer coating solution containing metal oxide particles, the compound represented by the formula (1), and a binder resin, forming a coat of the undercoat layer coating solution, and drying the coat by heating. The undercoat layer coating solution may be prepared by a method in which a solution including a binder resin dissolved therein is added to a dispersion liquid obtained by dispersing metal oxide particles and the compound represented by the formula (1) together with a solvent and furthermore the resulting mixture is subjected to a dispersion treatment. The dispersion may be performed with a homogenizer, an ultrasonic disperser, a ball mill, a sand mill, a roll mill, a vibration mill, an attritor, or a liquid collision high speed disperser.

Examples of the solvent used for the undercoat layer coating solution include organic solvents such as alcohol solvents, sulfoxide solvents, ketone solvents, ether solvents, ester solvents, halogenated aliphatic hydrocarbon solvents, and aromatic compounds.

The undercoat layer may further contain organic resin fine particles and a leveling agent.

The thickness of the undercoat layer is preferably 0.5 μm or more and 30 μm or less and more preferably 1 μm or more and 25 μm or less.

Photosensitive Layer

A photosensitive layer (charge generating layer, charge transporting layer) is formed on the undercoat layer.

Examples of a charge generating substance used in an embodiment of the present invention include azo pigments, phthalocyanine pigments, indigo pigments, perylene pigments, polycyclic quinone pigments, squarylium dyes, thiapyrylium salts, triphenylmethane dyes, quinacridone pigments, azulenium salt pigments, cyanine dyes, anthanthrone pigments, pyranthrone pigments, xanthene dyes, quinoneimine dyes, and styryl dyes. These charge generating substances may be used alone or in combination of two or more. Among these charge generating substances, phthalocyanine pigments and azo pigments can be used and phthalocyanine pigments can be particularly used from the viewpoint of sensitivity.

Among the phthalocyanine pigments, in particular, oxytitanium phthalocyanines, chlorogallium phthalocyanines, and hydroxygallium phthalocyanines exhibit high charge-generating efficiency. Among the hydroxygallium phthalocyanines, a hydroxygallium phthalocyanine crystal having strong peaks at Bragg angles 2θ of 7.4°±0.3° and 28.2°±0.3° in CuKα characteristic X-ray diffraction can be used from the viewpoint of sensitivity.

Examples of a binder resin used in the charge generating layer of a multilayer photosensitive layer include acrylic resin, allyl resin, alkyd resin, epoxy resin, diallyl phthalate resin, styrene-butadiene copolymers, butyral resin, benzal resin, polyacrylate resin, polyacetal resin, polyamide-imide resin, polyamide resin, polyallyl ether resin, polyarylate resin, polyimide resin, polyurethane resin, polyester resin, polyethylene resin, polycarbonate resin, polystyrene resin, polysulfone resin, polyvinyl acetal resin, polybutadiene resin, polypropylene resin, methacrylic resin, urea resin, vinyl chloride-vinyl acetate copolymers, vinyl acetate resin, and vinyl chloride resin. Among them, butyral resin can be particularly used. These binder resins may be used alone or in combination of two or more as a mixture or a copolymer.

The charge generating layer can be formed by applying a charge generating layer coating solution prepared by dispersing the charge generating substance together with the binder resin and a solvent and drying the charge generating layer coating solution. The charge generating layer may also be an evaporated film made of a charge generating substance.

The content of the charge generating substance can be 0.3 parts by mass or more and 10 parts by mass or less relative to 1 part by mass of the binder resin.

Examples of the solvent used for the charge generating layer coating solution include alcohol solvents, sulfoxide solvents, ketone solvents, ether solvents, ester solvents, halogenated aliphatic hydrocarbon solvents, and aromatic compounds. The thickness of the charge generating layer is preferably 0.01 μm or more and 5 μm or less and more preferably 0.1 μm or more and 2 μm or less. The charge generating layer may optionally contain various additive agents such as a sensitizer, an antioxidant, an ultraviolet absorber, and a plasticizer.

In an electrophotographic photosensitive member including a multilayer photosensitive layer, a charge transporting layer is formed on a charge generating layer.

Examples of a charge transporting substance used in an embodiment of the present invention include triarylamine compounds, hydrazone compounds, styryl compounds, stilbene compounds, and butadiene compounds. These charge transporting substances may be used alone or in combination of two or more. Among them, triarylamine compounds can be used from the viewpoint of achieving high mobility of charge.

Examples of a binder resin used in the charge transporting layer of a multilayer photosensitive layer include acrylic resin, acrylonitrile resin, allyl resin, alkyd resin, epoxy resin, silicone resin, phenolic resin, phenoxy resin, polyacrylamide resin, polyamide-imide resin, polyamide resin, polyallyl ether resin, polyarylate resin, polyimide resin, polyurethane resin, polyester resin, polyethylene resin, polycarbonate resin, polysulfone resin, polyphenylene oxide resin, polybutadiene resin, polypropylene resin, and methacrylic resin. Among them, polyarylate resin and polycarbonate resin can be used. These binder resins may be used alone or in combination of two or more as a mixture or a copolymer.

The charge transporting layer can be formed by applying a charge transporting layer coating solution prepared by dissolving the charge transporting substance and the binder resin in a solvent and drying the charge transporting layer coating solution. In the charge transporting layer, the content of the charge transporting substance can be 0.3 parts by mass or more and 10 parts by mass or less relative to 1 part by mass of the binder resin. The drying temperature is preferably 60° C. or more and 150° C. or less and more preferably 80° C. or more and 120° C. or less to suppress the formation of cracks in the charge transporting layer. The drying time can be 10 minutes or more and 60 minutes or less.

Examples of the solvent used for the charge transporting layer coating solution include alcohol solvents, sulfoxide solvents, ketone solvents, ether solvents, ester solvents, halogenated aliphatic hydrocarbon solvents, and aromatic hydrocarbon solvents.

In the case where the charge transporting layer of the electrophotographic photosensitive member has a single layer structure, the thickness of the charge transporting layer is preferably 5 μm or more and 40 μm or less and more preferably 8 μm or more and 30 μm or less. In the case where the charge transporting layer has a multilayer structure, the thickness of a charge transporting layer on the support side can be 5 μm or more and 30 μm or less, and the thickness of a charge transporting layer on the surface side can be 1 μm or more and 10 μm or less.

The charge transporting layer may optionally contain various additive agents such as an antioxidant, an ultraviolet absorber, and a plasticizer.

In an embodiment of the present invention, a protective layer (second charge transporting layer) may be formed on the photosensitive layer (charge generating layer) in order to protect the photosensitive layer and improve the abrasion resistance and ease of cleaning.

The protective layer can be formed by applying a protective layer coating solution obtained by dissolving a binder resin in an organic solvent and drying the protective layer coating solution. Examples of the resin used for the protective layer include polyvinyl butyral resin, polyester resin, polycarbonate resin, polyamide resin, polyimide resin, polyarylate resin, polyurethane resin, styrene-butadiene copolymers, styrene-acrylic acid copolymers, and styrene-acrylonitrile copolymers.

To provide charge transportability to the protective layer, the protective layer may be formed by curing a monomer or polymer charge transporting substance having charge transportability using a cross-linking reaction. In particular, the protective layer can be a layer cured by polymerizing or cross-linking a charge transporting compound having a chain-polymerizable functional group. Examples of the chain-polymerizable functional group include an acrylic group, a methacrylic group, an alkoxysilyl group, and an epoxy group. Examples of the curing reaction include radical polymerization, ionic polymerization, thermal polymerization, photopolymerization, radiation polymerization (electron beam polymerization), plasma chemical vapor deposition (CVD), and photo-CVD.

The thickness of the protective layer is preferably 0.5 μm or more and 10 μm or less and more preferably 1 μm or more and 7 μm or less. The protective layer may optionally contain electroconductive particles or the like.

The outermost layer (charge transporting layer or protective layer) of the electrophotographic photosensitive member may contain a lubricant such as silicone oil, wax, fluorine-containing resin particles, e.g., polytetrafluoroethylene particles, silica particles, alumina particles, or boron nitride.

The coating solution for each of the layers can be applied by dipping (dip coating), spray coating, spinner coating, roller coating, Meyer bar coating, blade coating, or the like.

Electrophotographic Apparatus

FIG. 1 is a schematic view showing an electrophotographic apparatus that includes a process cartridge including an electrophotographic photosensitive member according to an embodiment of the present invention.

In FIG. 1, a cylindrical electrophotographic photosensitive member 1 is rotated about a shaft 2 at a predetermined peripheral speed in a direction indicated by an arrow. During the rotation, the surface of the electrophotographic photosensitive member 1 is uniformly charged at a predetermined negative potential by a charging device 3 (a first charging device such as a charging roller). The electrophotographic photosensitive member 1 is then irradiated with intensity-modulated exposure light (image exposure light) 4 emitted from an exposure device (not shown) such as a slit exposure device or a laser beam scanning exposure device, in response to the time-series electric digital image signals of intended image information. Thus, electrostatic latent images corresponding to intended images are successively formed on the surface of the electrophotographic photosensitive member 1.

The electrostatic latent images formed on the surface of the electrophotographic photosensitive member 1 are subjected to reversal development with a toner contained in a developer of a developing device 5 and are made visible as toner images. The toner images formed on the surface of the electrophotographic photosensitive member 1 are successively transferred onto a transfer member (e.g., paper) P by a transferring bias from a transferring device (e.g., transfer roller) 6. The transfer member P taken from a transfer member feeding unit (not shown) in synchronism with the rotation of the electrophotographic photosensitive member 1 is fed to a portion (contact portion) between the electrophotographic photosensitive member 1 and the transferring device 6. A bias voltage having polarity opposite to the polarity of the electric charge of the toner is applied to the transferring device 6 from a bias power supply (not shown).

The transfer member P onto which toner images have been transferred is then separated from the surface of the electrophotographic photosensitive member 1 and is conveyed to a fixing device 8. After the toner images are fixed, the transfer member P is output from the electrophotographic apparatus as an image-formed article (such as a print or a copy).

The surface of the electrophotographic photosensitive member 1 after the toner images have been transferred is cleaned by removing an untransferred developer (residual toner) with a cleaning device (e.g., cleaning blade) 7. The electricity is removed with pre-exposure light (not shown) from a pre-exposure device (not shown), and then the electrophotographic photosensitive member 1 is repeatedly used for image forming. In the case where the charging device 3 is a contact charging device such as a charging roller as shown in FIG. 1, pre-exposure is not necessarily required.

According to an embodiment of the present invention, a plurality of components selected from the electrophotographic photosensitive member 1, the charging device 3, the developing device 5, the transferring device 6, and the cleaning device 7 may be incorporated in a container and integrally supported to provide a process cartridge. The process cartridge may be detachably attachable to the main body of an electrophotographic apparatus such as a copying machine or a laser-beam printer. In FIG. 1, the electrophotographic photosensitive member 1 and the charging device 3, the developing device 5, and the cleaning device 7 may be integrally supported to provide a process cartridge 9, which is detachably attachable to the main body of an electrophotographic apparatus using a guide unit 10 such as a rail of the main body.

For example, in the case where the electrophotographic apparatus is a copying machine or a printer, the exposure light 4 is reflected light or transmitted light from an original. Alternatively, the exposure light 4 is light applied by scanning with a laser beam according to signals into which an original read by a sensor is converted, or driving of an LED array or a liquid-crystal shutter array.

EXAMPLES

The present invention will now be further described in detail based on specific Example, but is not limited thereto. In EXAMPLES, "part" means "part by mass".

Example 1

An aluminum cylinder having a diameter of 30 mm and a length of 357.5 mm was used as a support (electroconductive support).

Next, 100 parts of zinc oxide particles (specific surface: 19 $m^2/g$, powder resistivity: $4.7\times10^6\Omega\cdot cm$) serving as a metal oxide were mixed with 500 parts of toluene under stirring, and 0.8 parts of silane coupling agent (compound name: N-2-(aminoethyl)-3-aminopropylmethyldimethoxysilane, trade name: KBM 602 manufactured by Shin-Etsu Chemical Co., Ltd.) was added thereto and stirring was performed for six hours. Subsequently, toluene was distilled off in a reduced pressure and drying by heating was performed at 130° C. for six hours to obtain surface-treated zinc oxide particles.

Next, 15 parts of butyral resin (trade name: BM-1 manufactured by Sekisui Chemical Co., Ltd.) serving as polyol resin and 15 parts of blocked isocyanate (trade name: Sumidur 3175 manufactured by Sumika Bayer Urethane Co., Ltd.) were dissolved in a mixed solution of 73.5 parts of methyl ethyl ketone and 73.5 parts of 1-butanol. To this solution, 80.64 parts of the surface-treated zinc oxide particles and 0.8 parts of a compound represented by the formula (1-1) above (manufactured by TOKYO CHEMICAL INDUSTRY Co., Ltd.) were added. The mixture was dispersed at 23±3° C. for three hours with a sand mill that uses glass beads having a diameter of 0.8 mm. After the dispersion, 0.01 parts of silicone oil (trade name: SH28PA manufactured by Dow Corning Toray Silicone Co., Ltd.) and 5.6 parts of cross-linked polymethyl methacrylate (PMMA) particles (trade name: TECK POLYMER SSX-102 manufactured by Sekisui Chemical Co., Ltd., average primary particle size: 2.5 μm) were added thereto and stirred to prepare an undercoat layer coating solution.

The undercoat layer coating solution was applied onto the support by dip coating, and the resultant layer was dried by heating at 160° C. for 40 minutes to form an undercoat layer having a thickness of 18 μm.

Subsequently, 4 parts of a hydroxygallium phthalocyanine crystal (charge generating substance) having strong peaks at Bragg angles 2θ±0.2° of 7.4° and 28.1° in CuKα characteristic X-ray diffraction and 0.04 parts of a compound represented by structural formula (A) below were added to a solution obtained by dissolving 2 parts of polyvinyl butyral resin (trade name: S-LEC BX-1 manufactured by Sekisui Chemical Co., Ltd.) in 100 parts of cyclohexanone. The mixture was then dispersed at 23±3° C. for one hour with a sand mill that uses glass beads having a diameter of 1 mm. After the dispersion, 100 parts of ethyl acetate was added thereto and thus a charge generating layer coating solution was prepared. The charge generating layer coating solution was applied onto the undercoat layer by dip coating, and the resultant layer was dried at 90° C. for 10 minutes to form a charge generating layer having a thickness of 0.21 μm.

Next, 50 parts of a compound (charge transporting substance) represented by structural formula (B) below, 50 parts of a compound (charge transporting substance) represented by structural formula (C) below, and 100 parts of polycarbonate resin (trade name: Iupilon Z400 manufactured by MITSUBISHI GAS CHEMICAL Company, Inc.) were dissolved in a mixed solvent of 650 parts of chlorobenzene and 150 parts of dimethoxymethane to prepare a charge transporting layer coating solution. The charge transporting layer coating solution, which was left for one day after the solution became homogeneous, was applied onto the charge generating layer by dip coating, and the resultant layer was dried at 110° C. for 60 minutes to form a charge transporting layer (first charge transporting layer) having a thickness of 18 μm.

(B)

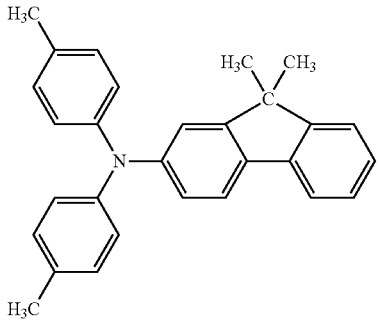

(C)

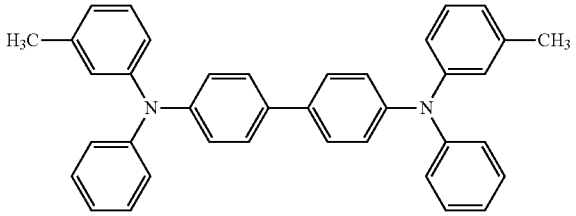

Next, 36 parts of a compound (a charge transporting substance having an acrylic group, which is a chain-polymerizable functional group) represented by structural formula (D) below, 4 parts of polytetrafluoroethylene resin fine powder (LUBRON L-2 manufactured by DAIKIN INDUSTRIES, LTD.), and 60 parts of n-propanol were mixed and dispersed with an ultra-high pressure disperser to prepare a protective layer coating solution.

(A)

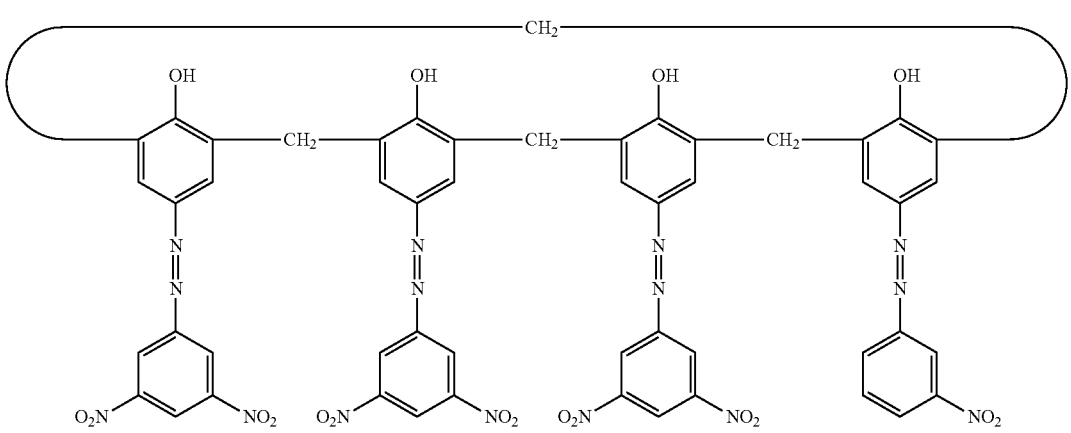

(D)

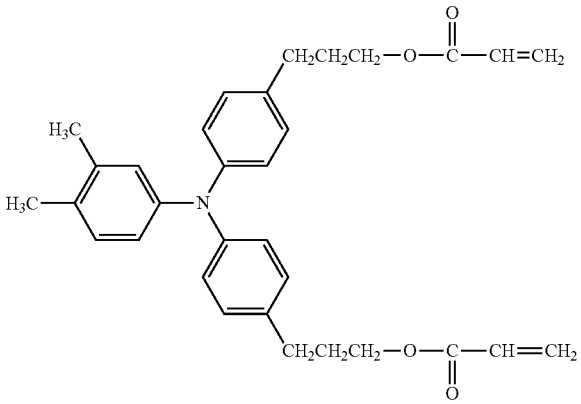

The protective layer coating solution was applied onto the charge transporting layer by dip coating, and the resultant layer was dried at 50° C. for 5 minutes. The dried layer was then cured by being irradiated with an electron beam in a nitrogen atmosphere at an accelerating voltage of 70 kV at an absorbed dose of 8000 Gy for 1.6 seconds while rotating a cylinder. The layer was heat-treated in a nitrogen atmosphere for three minutes under the condition that the temperature of the layer was 120° C. The processes from the electron beam irradiation to the three-minute heat treatment were performed at an oxygen concentration of 20 ppm. Subsequently, the layer was heat-treated in the air for 30 minutes under the condition that the temperature of the layer was 100° C., whereby a protective layer (second charge transporting layer) having a thickness of 5 μm was formed.

Accordingly, an electrophotographic photosensitive member was produced. The electrophotographic photosensitive member included the support, the undercoat layer, the charge generating layer, the charge transporting layer (first charge transporting layer), and the protective layer (second charge transporting layer) in that order.

Examples 2 to 21

An electrophotographic photosensitive member was produced in the same manner as in Example 1, except that the type of the metal oxide particles used in the undercoat layer coating solution was changed to that listed in Table 1 and the type and content of the compound represented by the formula (1) were changed to those listed in Table 1.

TABLE 1

| | | Compound represented by formula (1) | |
|---|---|---|---|
| Example | Metal oxide particles | Example compound | Content (part) |
| 1 | Zinc oxide particles | (1-1) | 1 |
| Reference 2 | Zinc oxide particles | (1-1) | 0.02 |
| 3 | Zinc oxide particles | (1-1) | 0.05 |
| 4 | Zinc oxide particles | (1-1) | 0.2 |
| 5 | Zinc oxide particles | (1-1) | 4 |
| Reference 6 | Zinc oxide particles | (1-1) | 6 |
| 7 | Zinc oxide particles | (1-4) | 2 |
| Reference 8 | Zinc oxide particles | (1-2) | 0.05 |
| Reference 9 | Zinc oxide particles | (1-2) | 2 |
| Reference 10 | Titanium oxide particles | (1-16) | 0.05 |
| Reference 11 | Titanium oxide particles | (1-16) | 2 |
| Reference 12 | Zinc oxide particles | (1-3) | 2 |
| 13 | Titanium oxide particles | (1-1) | 1 |
| Reference 14 | Zinc oxide particles | (1-14) | 1 |
| 15 | Titanium oxide particles | (1-12) | 1 |
| 16 | Zinc oxide particles | (1-12) | 0.2 |
| 17 | Zinc oxide particles | (1-12) | 4 |
| Reference 18 | Zinc oxide particles | (1-5) | 2 |
| Reference 19 | Zinc oxide particles | (1-9) | 2 |
| Reference 20 | Titanium oxide particles | (1-8) | 2 |
| 21 | Zinc oxide particles | (1-25) | 1 |

The titanium oxide particles used had a specific surface of 20.5 $m^2/g$ and a powder resistivity of $6.0\times10^5\Omega\cdot cm$.

Comparative Example 1

An electrophotographic photosensitive member was produced in the same manner as in Example 1, except that the compound represented by the formula (1-1) was not used.

Comparative Example 2

An electrophotographic photosensitive member was produced in the same manner as in Example 1, except that the compound represented by the formula (1-1) was changed into a compound represented by formula (E-1) below.

(E-1)

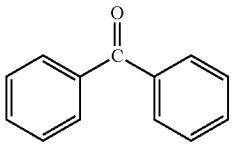

Comparative Example 3

An electrophotographic photosensitive member was produced in the same manner as in Example 1, except that the compound represented by the formula (1-1) was changed into a compound represented by formula (E-2) below.

(E-2)

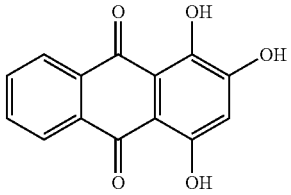

Comparative Example 4

An electrophotographic photosensitive member was produced in the same manner as in Example 1, except that the zinc oxide particles were not used.

Comparative Example 5

An electrophotographic photosensitive member was produced in the same manner as in Example 1, except that the compound represented by the formula (1-1) was not used in the undercoat layer, but 4 parts of the compound represented by the formula (1-1) was used in the charge transporting layer.

Evaluation

The electrophotographic photosensitive members in Examples 1 to 21 and Comparative Examples 1 to 5 were evaluated as follows regarding the light area potential and ghost image evaluation in the repeated use of the electrophotographic photosensitive members.

Ghost Image Evaluation

A customized copying machine of imageRUNNER iR-ADV C5051 manufactured by CANON KABUSHIKI KAISHA was used as an electrophotographic apparatus for evaluation.

The electrophotographic copying machine and each of the electrophotographic photosensitive members were left to stand in a low-temperature and low-humidity environment of 15° C. and 10% RH for three days. Subsequently, the laser light intensity and applied voltage were adjusted so that an initial light area potential was set to be −150 V and an initial dark area potential was set to be −750 V, and a ghost image evaluation was performed. Then, printing of 2000 sheets was performed in the same environment. A ghost image evaluation immediately after the printing of 2000 sheets and a ghost image evaluation 15 hours after the printing of 2000 sheets were performed under the same laser light intensity conditions. Table 2 shows the results.

In the printing that used the electrophotographic photosensitive member, a line having a width of 0.5 mm was printed at intervals of 10 mm in the vertical direction in an intermittent mode in which four sheets can be printed per minute.

Figure 3:
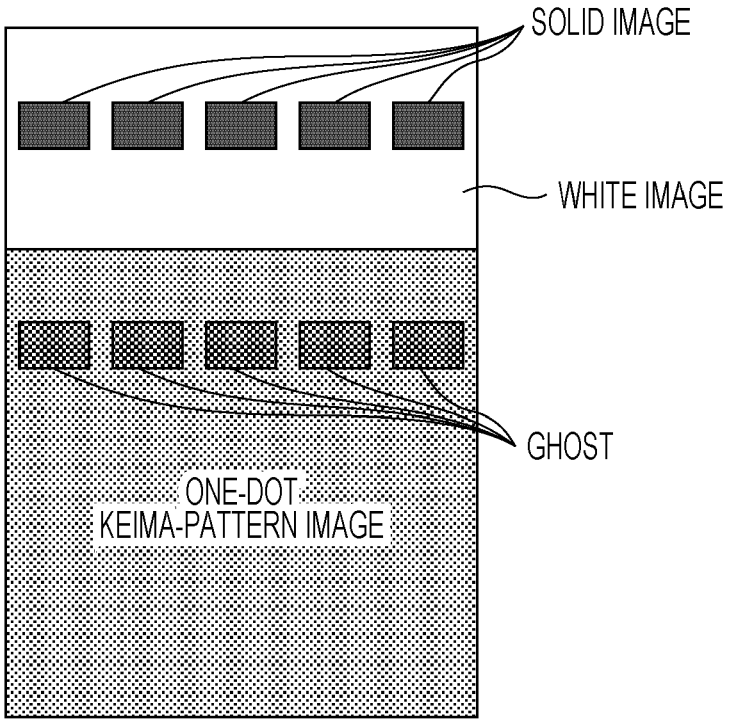
FIG. 3 is a diagram for describing printing for ghost image evaluation, the printing being used when a ghost image is evaluated.
Figure 4:
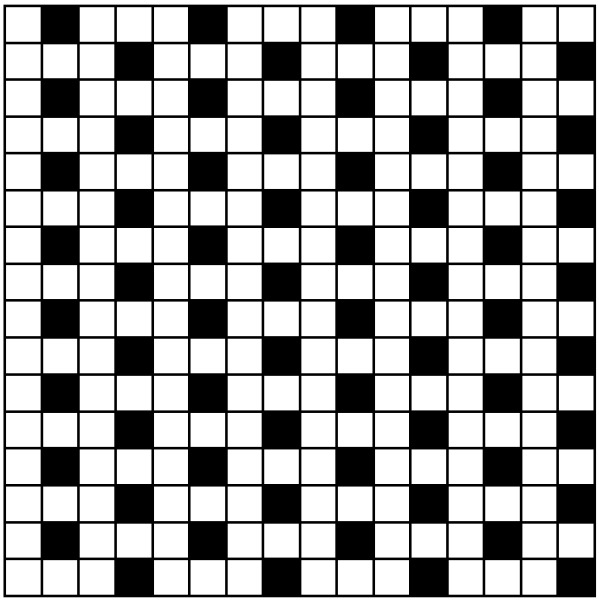
FIG. 4 is a diagram for describing a one-dot keima-pattern image.

The ghost image evaluation was performed as follows. After the completion of the printing of 2000 sheets, printing for ghost image evaluation was performed and a white image was printed in the entire sheet. The printing for ghost image evaluation is described below. As shown in FIG. 3, quadrilateral solid images were printed in a white background (white image) at the top part of an image, and then one-dot keima-pattern image was printed. The one-dot keima-pattern image in FIG. 3 is the pattern image shown in FIG. 4. The portions referred to as "ghost" in FIG. 3 are ghost portions used to evaluate whether ghosts caused by the solid images appear. When ghosts appear, they appear in the portions referred to as "ghost" in FIG. 3.

The sampling for ghost image evaluation was conducted in the F5 (intermediate density) mode and the F9 (low density) mode (mode in which ghosts are more visible) of the developing volume of the electrophotographic apparatus for evaluation. The ghosts were evaluated through visual inspection on the basis of the following criteria. In the present invention, Ranks 1 and 2 were levels at which the advantageous effects according to an embodiment of the present invention were produced. In particular, Rank 1 was judged to be an excellent level. Ranks 3, 4, and 5 were judged to be levels at which the advantageous effects according to an embodiment of the present invention were not produced.

Rank 1: ghosts are not visible in both modes
Rank 2: ghosts are slightly visible in one of the modes
Rank 3: ghosts are slightly visible in both modes
Rank 4: ghosts are visible in both modes
Rank 5: ghosts are clearly visible in both modes

TABLE 2

| | Ghost evaluation | | |
|---|---|---|---|
| | Initial | Immediately after printing of 2000 sheets | 15 hours after printing of 2000 sheets |
| Example 1 | 1 | 1 | 1 |
| Reference Example 2 | 1 | 2 | 2 |
| Example 3 | 1 | 1 | 1 |
| Example 4 | 1 | 1 | 1 |
| Example 5 | 1 | 1 | 1 |
| Reference Example 6 | 1 | 2 | 1 |
| Reference Example 7 | 1 | 1 | 1 |
| Reference Example 8 | 1 | 2 | 2 |
| Reference Example 9 | 1 | 2 | 1 |
| Reference Example 10 | 2 | 2 | 2 |
| Reference Example 11 | 1 | 2 | 2 |
| Reference Example 12 | 1 | 2 | 1 |
| Example 13 | 1 | 1 | 1 |
| Reference Example 14 | 1 | 2 | 2 |
| Example 15 | 1 | 1 | 1 |
| Example 16 | 1 | 1 | 1 |
| Example 17 | 1 | 1 | 1 |
| Reference Example 18 | 1 | 2 | 2 |
| Reference Example 19 | 1 | 2 | 1 |
| Reference Example 20 | 1 | 2 | 1 |
| Example 21 | 1 | 1 | 1 |
| Comparative Example 1 | 3 | 5 | 4 |
| Comparative Example 2 | 4 | 5 | 4 |
| Comparative Example 3 | 2 | 3 | 3 |
| Comparative Example 4 | This cannot be evaluated due to lack of sensitivity | | |
| Comparative Example 5 | 4 | 5 | 4 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-262120 filed Nov. 30, 2011 and No. 2012-244529 filed Nov. 6, 2012, which are hereby incorporated by reference herein in their entirety.

What is claimed is:

1. An electrophotographic photosensitive member, comprising:

a support;

an undercoat monolayer formed on the support; and a photosensitive layer formed on the undercoat monolayer, wherein the undercoat monolayer comprises metal oxide particles and a compound represented by the following formula (1), and (1)

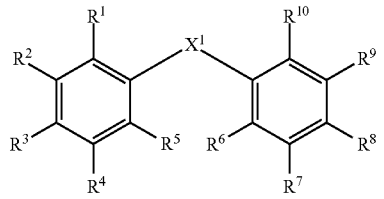

wherein, in the formula (1), $R^1$ to $R^{10}$ each independently represents a hydrogen atom, a halogen atom, a hydroxy group, an alkyl group, an alkoxy group, or an amino group, at least three of $R^1$ to $R^{10}$ are hydroxy groups, and $X^1$ represents a carbonyl group or a dicarbonyl group, wherein the content of the compound represented by the formula (1) in the undercoat monolayer is not less than 0.05% by mass and not more than 4% by mass relative to the total mass of the metal oxide particles in the undercoat monolayer.

2. The electrophotographic photosensitive member according to claim 1, wherein the metal oxide particles are particles comprising at least one selected from the group consisting of titanium oxide and zinc oxide.

3. The electrophotographic photosensitive member according to claim 1, wherein the undercoat monolayer further comprises a binder resin.

4. The electrophotographic photosensitive member according to claim 3, wherein the binder resin is a polyurethane resin.

5. A process cartridge detachably attachable to a main body of an electrophotographic apparatus, wherein the process cartridge integrally supports:

the electrophotographic photosensitive member according to claim 1, and at least one device selected from the group consisting of a charging device, a developing device, a transferring device, and a cleaning device.

6. An electrophotographic apparatus comprising:

the electrophotographic photosensitive member according to claim 1;

a charging device;
an exposure device;
a developing device; and
a transferring device.
7. The electrophotographic photosensitive member according to claim 1,
wherein the compound represented by the formula (1) is a compound represented by any one of the formulas (1-1), (1-4), (1-12), (1-22) and (1-25)
(1-1)
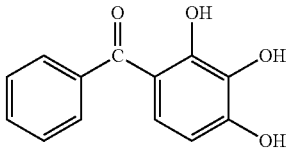
(1-4)
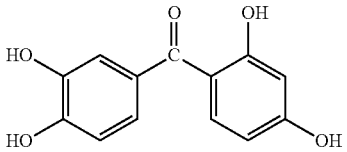
-continued
(1-12)
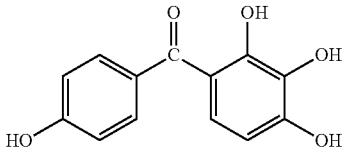
(1-22)
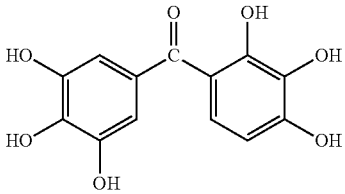
(1-25)
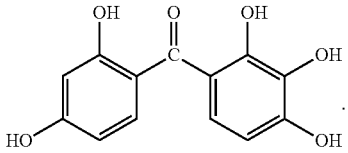
* * * * *